US005687855A

United States Patent [19]

Heller

[11] Patent Number: 5,687,855

[45] Date of Patent: Nov. 18, 1997

[54] DISPOSABLE TOOTHBRUSH HOLDER

[76] Inventor: Barry N. Heller, 933 Calle Miramar, Redondo Beach, Calif. 90277

[21] Appl. No.: 644,128

[22] Filed: May 10, 1996

[51] Int. Cl.[6] ..... A47B 81/02

[52] U.S. Cl. ..... 211/65; D6/534

[58] Field of Search ..... 211/65, 70.7; D6/534, D6/528, 551; D19/77, 80, 81, 82, 84, 85

[56] References Cited

U.S. PATENT DOCUMENTS

| | | | |
|---|---|---|---|
| D. 64,970 | 6/1924 | Gooch | D19/85 X |
| D. 145,867 | 11/1946 | Fletcher | D19/85 X |
| D. 168,307 | 12/1952 | Lenard | D19/85 X |
| D. 211,295 | 6/1968 | Wolf | D19/85 |
| D. 217,993 | 7/1970 | Woofter | D19/77 X |
| D. 262,121 | 12/1981 | Brady | D19/82 |
| D. 270,878 | 10/1983 | Sabatella | D6/534 |
| D. 286,349 | 10/1986 | Bussell | D6/534 |
| D. 327,800 | 7/1992 | Hollinger | D6/534 |
| 2,117,459 | 5/1938 | Stanton | 211/65 |
| 4,534,474 | 8/1985 | Ng | 211/70.7 X |
| 4,770,379 | 9/1988 | Estvold | 211/65 X |
| 5,484,065 | 1/1996 | Davoli, Jr. et al. | 211/65 |

*Primary Examiner*—Alvin C. Chin-Shue
*Assistant Examiner*—Sandra Snapp
*Attorney, Agent, or Firm*—J. E. McTaggart

[57] ABSTRACT

A disposable toothbrush holder, particularly for the convenience and hygiene of visitors in motels and hotels, holds toothbrushes upright, bristle end up, for sanitary drying, supported in circular openings in a convex upper portion supported by integrally-formed legs. The holders can be molded economically from recyclable plastic material, and can be nested together for space-efficient packaging.

9 Claims, 2 Drawing Sheets

DISPOSABLE TOOTHBRUSH HOLDER

FIELD OF THE INVENTION

The present invention relates to the field of personal hygiene products, and more particularly it relates to a disposable toothbrush holder, particularly directed to travellers and motel/hotel guests.

BACKGROUND OF THE INVENTION

Temporary guests in hotel/motel rooms often experience inconvenience and frustration with regard to storing toothbrushes satisfactorily between usage. Close-fitting plastic storage enclosures prevent the bristles from drying. It is unsightly and unsanitary to leave the brush laying on a table top, sink or vanity: the bristles often remain in contact with a puddle of waste water.

Storage in upright orientation with the bristles at the top is preferred since this allows excess water to drain off downwardly and allows the brush to dry rapidly.

A drinking glass can be used for upright toothbrush storage, but this uses up one of the drinking glasses of which there are usually only a few available in a motel/hotel room. Since the residual waste liquid from the toothbrush accumulates in the bottom of the glass, it needs to be washed and sterilized before it is used for drinking purposes.

DISCUSSION OF RELATED KNOWN ART

U.S. Pat. No. 5,297,677 to Burian et al and U.S. Pat. No. 4,770,379 to Estvold disclose toothbrush holders formed from sheet metal, and thus are not considered to be disposable.

Re-usable toothbrush holders of known art having a closed container are subject to the above-mentioned problem of residual waste liquid accumulation in the bottom of the container.

In general, any non-disposable type of toothbrush holder potentially harbors lingering germs unless cleaned and sterilized frequently and diligently.

OBJECTS OF THE INVENTION

It is a primary object of the present invention to provide a toothbrush holder that can hold a plurality of toothbrushes in an upright position, bristle end up, and that is low enough in cost to be disposable as a "throw-way" item provided as a promotional convenience by a hotel or motel.

It is a further object to make the toothbrush holder to be constructable from recyclable plastic material for environmental conservation.

It is a still further object to configure the toothbrush holder in a shape that enables nesting for compact packaging of shipment quantities.

SUMMARY OF THE INVENTION

The abovementioned objects have been accomplished by the present invention of toothbrush holder having an upwardly-facing portion, configured with circular openings to receive toothbrushes, supported by integrally attached legs. The holder can be manufactured economically from recyclable plastic material in a molding process, and can be nested space-efficiently in quantities.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
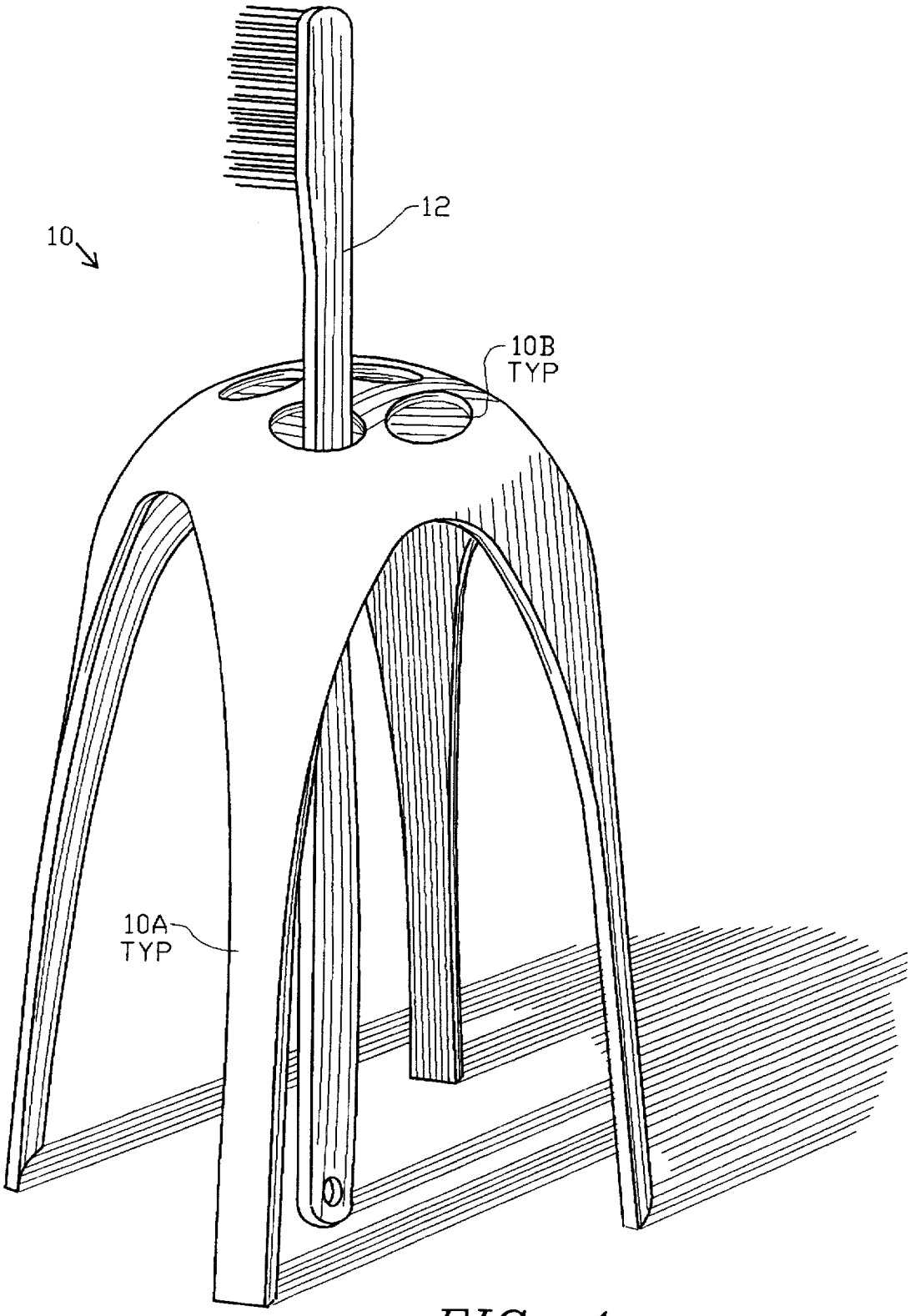
FIG. 1 is a perspective view of a toothbrush holder of the present invention, shown holding a single toothbrush.

FIG. 1 is a three-dimensional view illustrating a preferred embodiment of the present invention: toothbrush holder 10 having an upper portion with four integrally-formed legs 10A extending downwardly to a support surface such as a vanity or sink counter. The upper portion is configured with four upwardly-facing circular openings 10B, one of which is shown holding a toothbrush 12 in an upright position with the bristles at the top and the handle resting on the support surface. Up to four toothbrushes can be held in this manner, one in each circular opening 10B.

The general shape of holder 10 approximates a paraboloid, i.e. a surface of revolution of a parabola about its central axis, with material removed to form legs 10A between arched voids as shown arranged uniformly around the lower region. The holder 10 may be formed as a shell of substantially constant thickness, and its shape makes it easy to manufacture from plastic material in a molding process. The tapered shaped allows any quantity holders 10 to be nested together in a stack for space efficiency in shipment, in the well-known manner in which paper cups are packaged.

Figure 2:
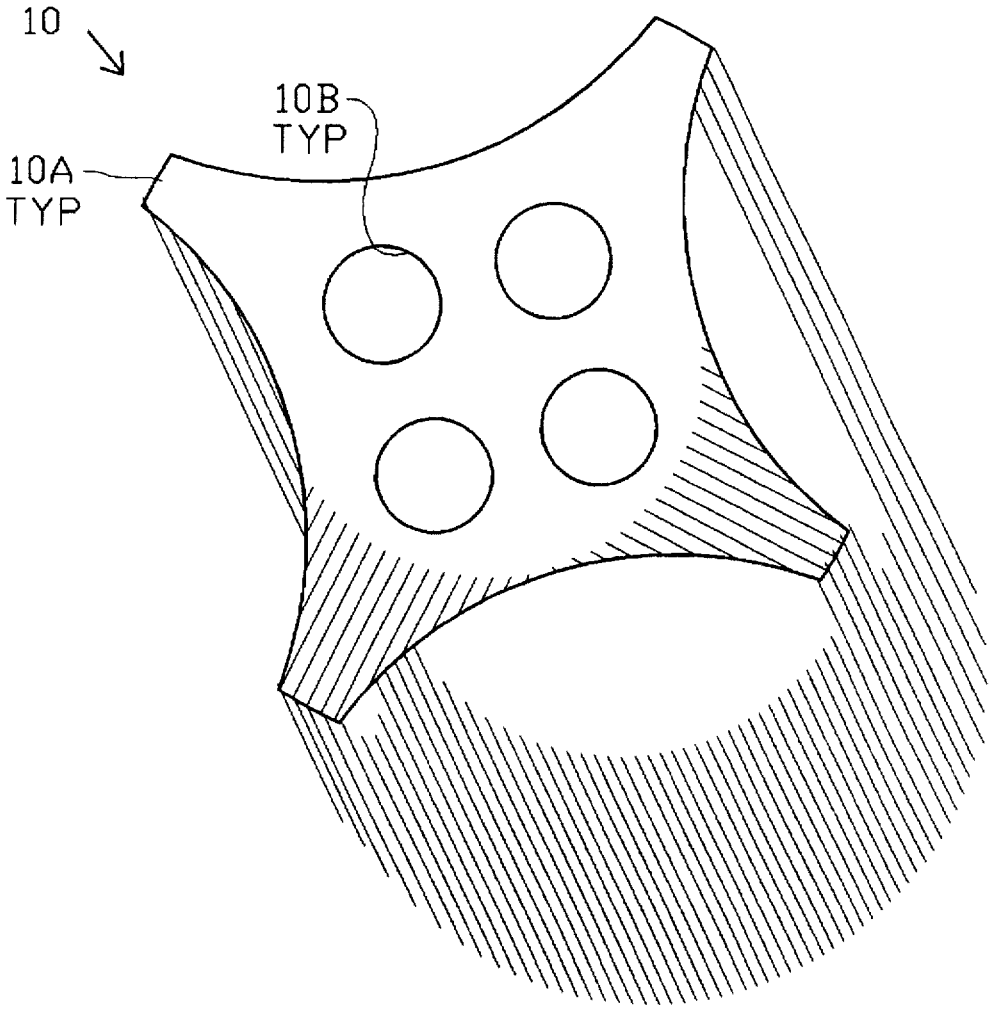
FIG. 2 is top view of the toothbrush holder of FIG. 1.

The top view of FIG. 2 shows the polar array pattern of the four circular openings 10B, disposed at the same uniform angular spacing as the four legs 10A.

In an illustrative embodiment of the invention, shaped as shown in FIG. 1 and 2, the holder 10 can be made 4½" high by a square 2½" per side at the bottom of the legs, and openings 10B can be ¾" in diameter.

While the illustrative embodiment shows four openings 10B and four legs 10A, the invention can be practiced with any desired number of toothbrush-holding openings 10B, and with a different number of legs, e.g. three.

The invention could also be practiced with different overall body shapes of the holder 10, e.g. cylindrical, conical, or orthogonal; also with different shapes of the legs 10A and the void regions therebetween.

Holder 10 may be molded economically from polystyrene; e.g. with a uniform thickness of 1/16". As an alternative to uniform thickness, plastic material can be saved by making the main surface thinner and configuring the mold to provide thickened strengthening beads along the edges of the arches forming the legs 10A, and/or around the circular openings 10B.

As an alternative to molding, holder 10 could be cut and formed from a flat sheet of plastic material in a thermal process.

As an alternative to plastic material, holder 10 could be made from metal, e.g. aluminum, in a molding or pressing process.

It is envisioned that a company logo or other promotional matter may be printed on the outer surface of the holder.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A toothbrush holder, intended to be disposable rather than permanent, comprising:

an upwardly-facing top portion constructed and arranged to provide a plurality of upwardly-facing openings shaped and dimensioned to each receive and support a toothbrush having a bristle end and a handle end; and a plurality of legs, formed integrally with said top portion and extending downwardly therefrom, constructed and arranged to rest on a flat horizontal support surface and thus support said top portion at a predetermined height above the support surface;

said toothbrush holder being thusly constructed and arranged to support toothbrushes in an upright disposition with the bristle end extending upwardly from said holder and the handle end resting on the support surface; and said toothbrush holder being configured as a shell, having a substantially uniform wall thickness throughout, shaped internally and externally in a manner that permits a plurality of said holders to be nested compactly for bulk storage and shipping purposes.

2. The toothbrush holder as defined in claim 1 wherein said holder is constructed and arranged to have an overall shape approximating a paraboloid, defines as a surface of revolution of a parabola about a vertical central axis, such that said top portion is made to have an upwardly-facing convex surface shape, lower regions of the paraboloid being voided in a manner to articulate said legs.

3. The toothbrush holder as defined in claim 2 wherein said legs are tapered, at least in part, to become smaller in a downward direction, and the voided regions between said legs are each configured in an arched shape.

4. The toothbrush holder as defined in claim 3, constructed and arranged to have four of said legs arranged in a uniform polar array about the central axis, such that the voided regions therebetween are four in number and are uniform in size and shape.

5. The toothbrush holder as defined in claim 1, wherein the openings in said top portion are each made circular in shape.

6. The toothbrush holder as defined in claim 2, constructed and arranged to have four of the circular openings in said top portion arranged in a uniform polar array about the central axis.

7. The toothbrush holder as defined in claim 1, constructed from recyclable plastic.

8. The toothbrush holder as defined in claim 1, constructed in a molding process from polystyrene.

9. A disposable toothbrush holder, for uprightly supporting a plurality of toothbrushes each having a bristle end and a handle end, comprising:

a hollow plastic body having an overall outer surface shape approximately conforming to a paraboloid, defined as a surface of revolution of a parabola about a vertical central axis, said body comprising:

an upper portion constructed and arranged to have a convex upwardly-facing surface encompassing four circular openings arranged in a uniform polar array about the central axis, each opening being dimensioned to accept the handle end of one of the toothbrushes; and four legs, formed integrally with said upper portion and extending downwardly therefrom, having outwardly-facing surfaces conforming generally to the overall paraboloid shape, said legs being made and arranged to rest on a horizontal support surface and to thusly support said top portion at a predetermined height thereabove, said legs being configured in a uniform polar array about the central axis and defined in a generally tapered shape by four corresponding uniform arch-shaped void regions configured therebetween;

whereby each toothbrush is supported in an upright disposition with the bristle end extending upwardly from said body and the handle end resting on the flat support surface;

said body being constructed from recyclable plastic and formed as a shell with substantially uniform wall thickness throughout, and being shaped internally and externally in a manner that permits compact nested packaging of a plurality of said holders.

* * * * *